US005259209A

United States Patent [19]

Mitsumoto et al.

[11] Patent Number: 5,259,209

[45] Date of Patent: Nov. 9, 1993

[54] KNITTING METHOD FOR A BUTTONHOLE FOR A KNIT PRODUCT

[75] Inventors: Shigenobu Mitsumoto; Masao Okuno, both of Wakayama, Japan

[73] Assignee: Shima Seiki Mfg., Ltd., Wakayama, Japan

[21] Appl. No.: 831,586

[22] Filed: Feb. 5, 1992

[30] Foreign Application Priority Data

Feb. 6, 1991 [JP] Japan ..... 3-15219

[51] Int. Cl.[5] ..... D04B 1/22

[52] U.S. Cl. ..... 66/173; 66/169 R

[58] Field of Search ..... 66/169 R, 169 A, 170, 66/171, 171 R, 172 E, 173, 174, 175, 176, 64, 69, 70, 71, 73, 75.1, 76, 77

[56] References Cited

U.S. PATENT DOCUMENTS 1,054,233 2/1913 Mueller ..... 66/172 R
1,185,933 6/1916 Powell ..... 66/170
1,842,513 1/1932 Ensten ..... 66/171
3,531,952 10/1970 Chesebro ..... 66/171

*Primary Examiner*—Clifford D. Crowder
*Assistant Examiner*—Larry D. Worrell, Jr.
*Attorney, Agent, or Firm*—Edwin E. Greigg; Ronald E. Greigg

[57] ABSTRACT

A method for knitting a buttonhole in a knit product by using a knitting machine for forming the remainder of the knitted product employing the following steps: feeding a thread to a front knitting needle, transferring the loop held on the front knitting needle to a corresponding rear knitting needle, racking the needle bed leftward, transferring the two loops to a front needle, repeating the above steps leftward to form a bottom peripheral portion if the buttonhole, hooking a loop held on the front needle, racking and transferring the loop rightward to an empty front needle, repeating the steps rightward to increase the number of loops on the front knitting needles.

1 Claim, 17 Drawing Sheets

Fig.2
| | |
|---|---|
| ℧ . . . | knitting of a front stitch |
| Ω . . . | knitting of a back stitch |
| V . . . | a tuck |
| ⇄ . . . | moving direction of a carriage |
| ↕ . . . | moving direction of a loop |
| P . . . | moving pitch of a needle bed |
Fig.3-1
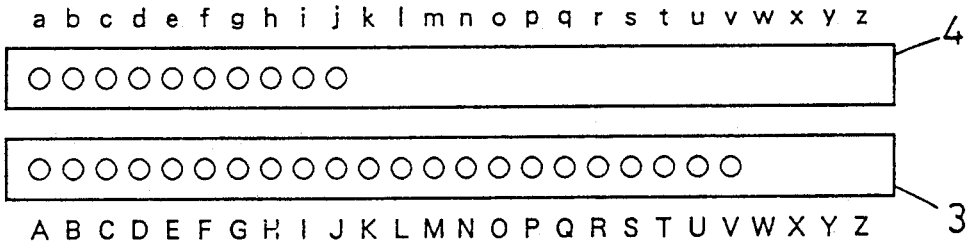
Fig.3-2
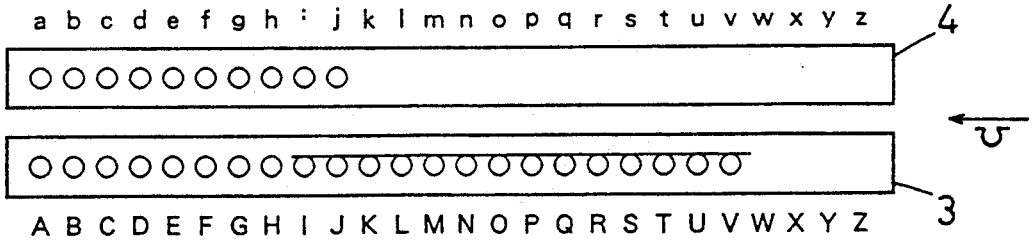
Fig.3-3
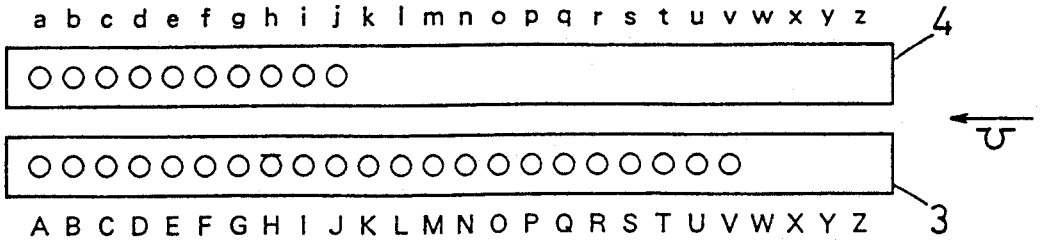

KNITTING METHOD FOR A BUTTONHOLE FOR A KNIT PRODUCT

BACKGROUND OF THE INVENTION

This invention refers to a knitting method for a buttonhole formed on overlapping parts of a knit product such as a cardigan and a knit fabric having buttonholes.

In the prior art, fabric is knitted and then the buttonholes are made in the fabric, in making a buttonhole on a fabric, a hole is formed on the fabric first and then the hole is stitched with a string attached along the edge of the hole by using a stitching machine.

Generally, two types of buttonholes are known, which are lateral type and vertical type. The buttonholes are lateral relative to the wale direction of the knit fabric. However, when a knit product having lateral buttonholes is put on and laterally stretched, loops forming the edge of the buttonhole are stretched out and the string attached along the buttonhole is released. Therefore, the vertical type of buttonhole is preferred for a knit product.

However, there is a problem that in case a button is held by a vertical buttonhole, the buttonhole opens unpleasantly by being stretched in a lateral direction. Thus, the design is damaged and the value of the product is degraded.

Further, a problem is that in the prior art buttonholes are formed by using another machine. The use of another machine to form the buttonholes leads to a complex knitting procedure and lowering of productivity.

OBJECT AND SUMMARY OF THE INVENTION

The present invention is provided in view of the above problems, and an object is to prevent damage to the shape of a product by employing a lateral buttonhole and to form buttonholes within a knitting procedure of a fabric.

A knitting method of a buttonhole for a knit product by using a flat knitting machine in the present invention comprises the steps of: binding off a desired number of loops in a wale direction of the knit product at a starting point of forming the buttonhole, the length of the loops corresponding to a desired width of a buttonhole, and releasing the loops from the knitting needles to form a bottom peripheral portion of the buttonhole, and forming an upper peripheral portion of the buttonhole above the bottom peripheral portion of the buttonhole.

The forming method of the upper peripheral portion of the buttonhole comprises: a step of increasing the loops one by one by employing a knitting method that is called "split-knit" from one end to the other end of the bottom peripheral portion of the buttonhole, wherein a loop held on a needle is made to be held also on another needle and a new loop is formed on the former needle, or a step of forming loops at both ends of an upper peripheral portion on both ends of the bottom peripheral portion of the buttonhole.

Further, a fabric having buttonholes comprises a bottom peripheral portion of a buttonhole which is formed by binding off some adjacent loops in a wale direction, of which the length of the loops corresponds to the width of a buttonhole, at the beginning of the buttonhole of a fabric knitted by using a flat knitting machine, an upper peripheral portion of the buttonhole is formed above the bottom peripheral portion of the buttonhole by a loop forming means.

BRIEF DESCRIPTION OF THE DRAWINGS

FIG. 2 is an explanatory drawing for marks used in knitting courses, FIGS. 3-1 to 3-38 are explanatory drawings of knitting courses for a buttonhole in a knit fabric in the embodiment 1, FIGS. 4-1 to 4-10 are explanatory drawings of knitting courses for a buttonhole in a second embodiment, FIGS. 5-1 to 5-10 are explanatory drawings of knitting courses for a buttonhole in a knit fabric in a third embodiment, FIGS. 6-1 to 6-8 are explanatory drawings of knitting courses for a buttonhole in a knit fabric in a fourth embodiment, and FIGS. 7-1 to 7-11 are explanatory drawings of knitting courses for a buttonhole in a knit fabric in a fifth embodiment.

DETAILED DESCRIPTION OF THE PREFERRED EMBODIMENTS

A knitting method for forming a buttonhole in a knit product of the present invention will be described with reference to the drawings hereinafter.

Embodiment 1

Figure 1:
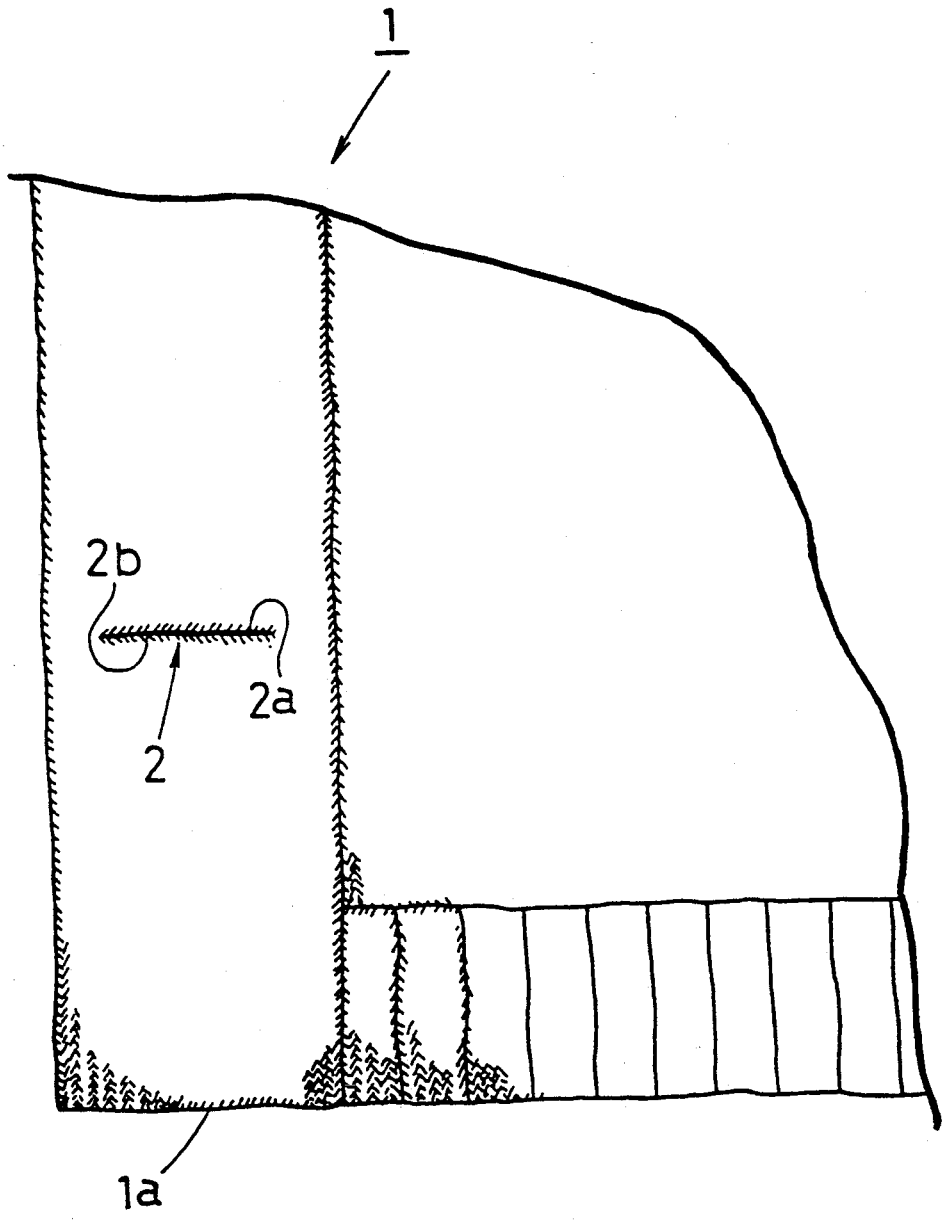
FIG. 1 is a front view of a buttonhole formed on a knit fabric knitted by the method in the present invention.

A flat knitting machine comprising front and rear needle beds which movably support knitting needles employed in the present embodiment, and FIGS. 3-1 to 3-38 show knitting courses of a buttonhole 2 laterally formed on a cardigan 1 as shown in FIG. 1.

Figures 1, 4:
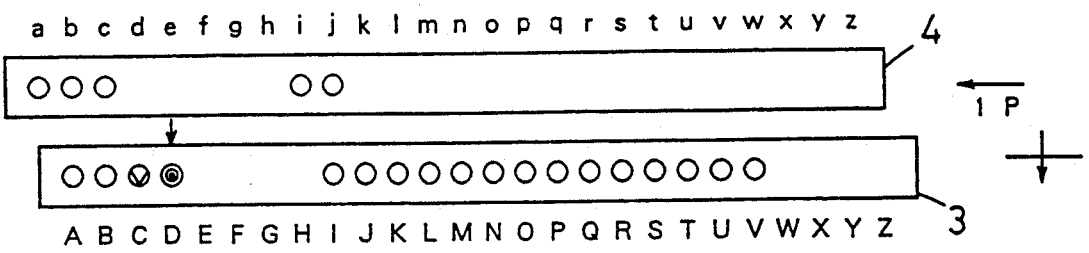
Figures 2, 4:
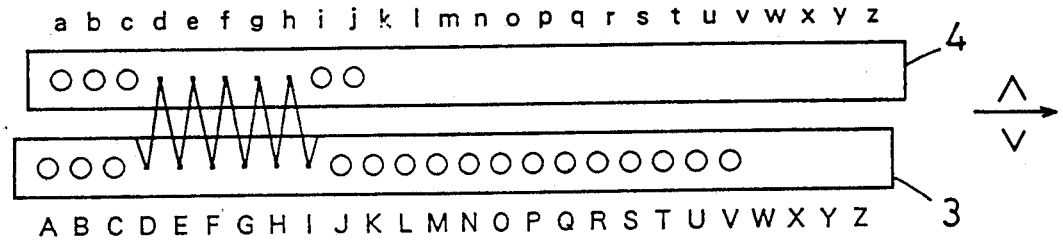
Figures 3, 4:
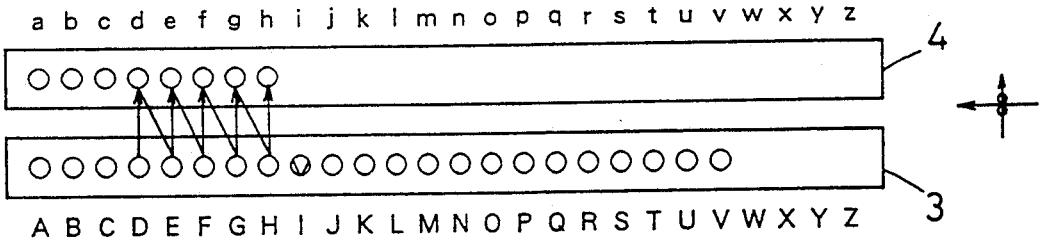
Figure 4:
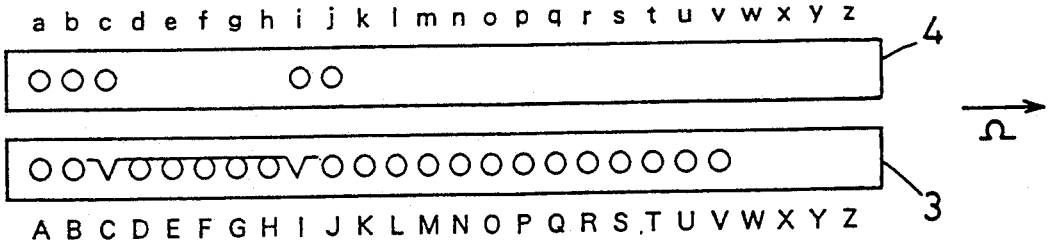
Figures 4, 5:
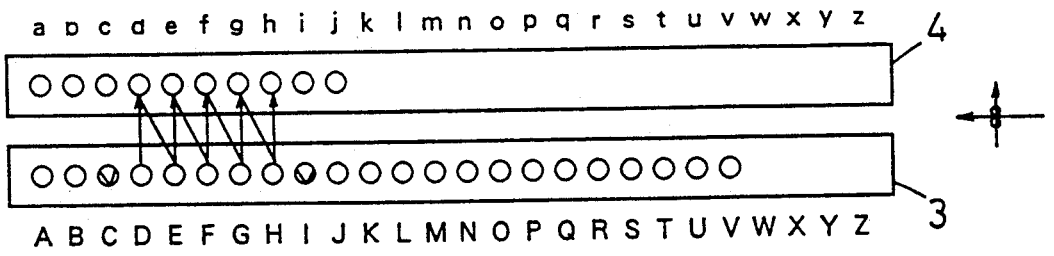
Figures 4, 5, 6:
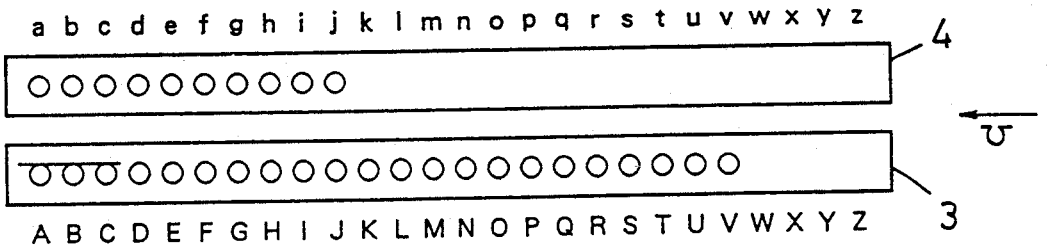
Figures 4, 5, 6, 7:
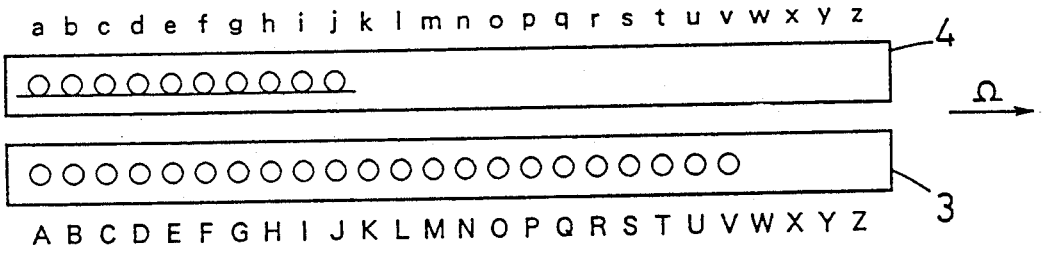
Figures 4, 5, 6, 7, 8:
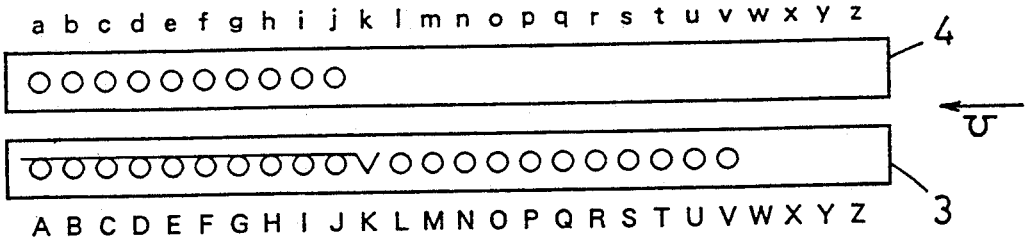
Figures 4, 5, 6, 7, 8, 9:
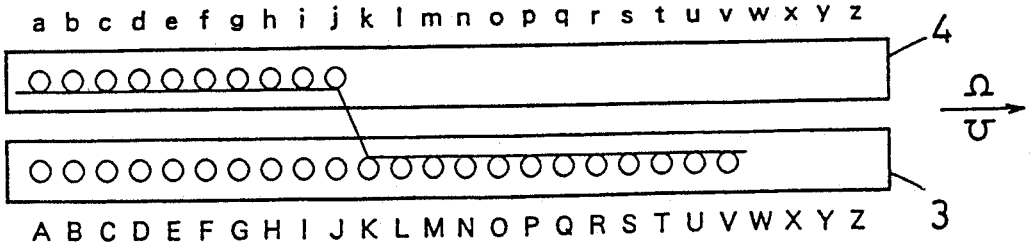
Figures 4, 5, 6, 7, 8, 9, 10:
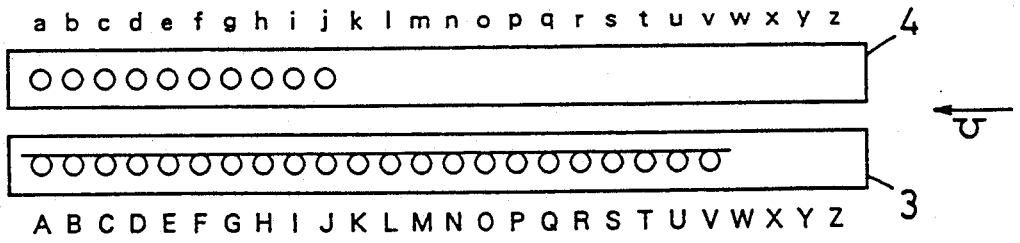
Figures 1, 5:
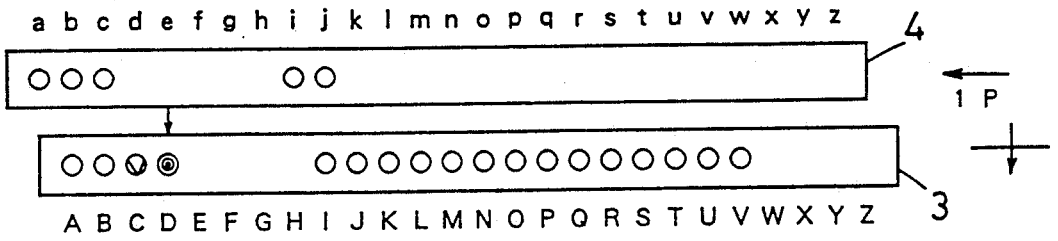
Figures 2, 5:
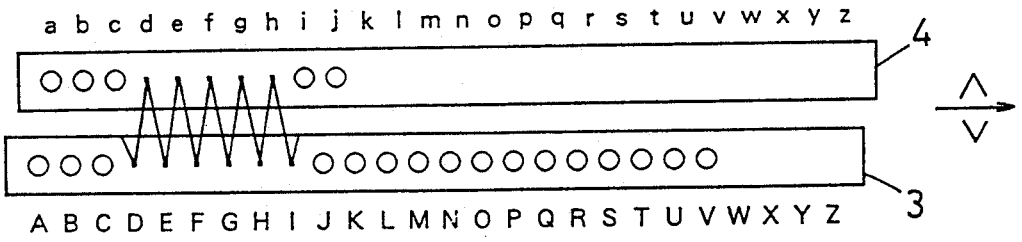
Figures 3, 5:
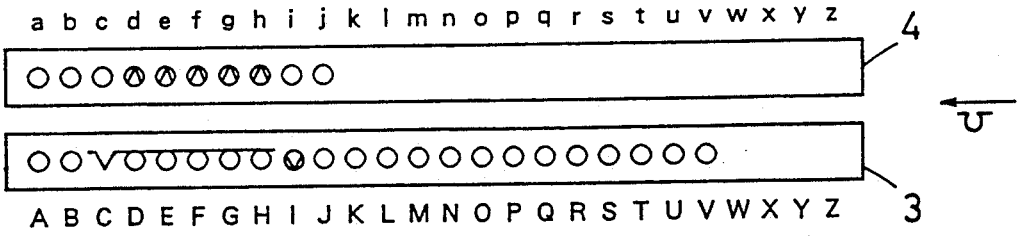
Figures 4, 5:
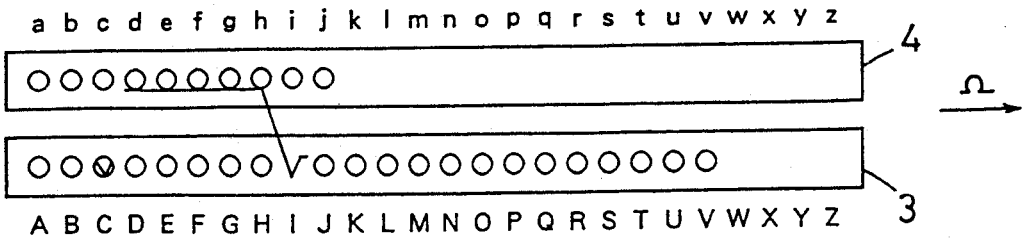
Figure 5:
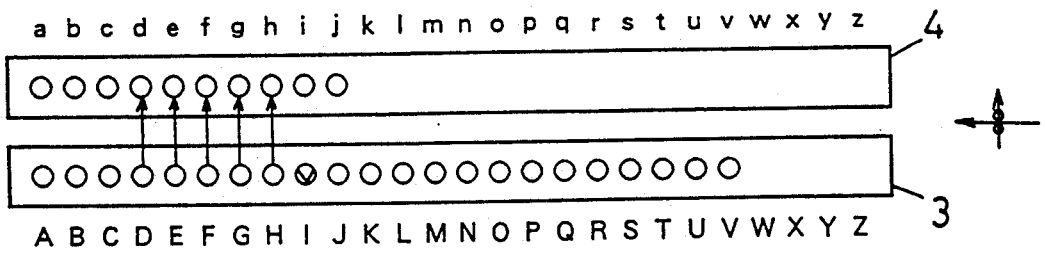
Figures 5, 6:
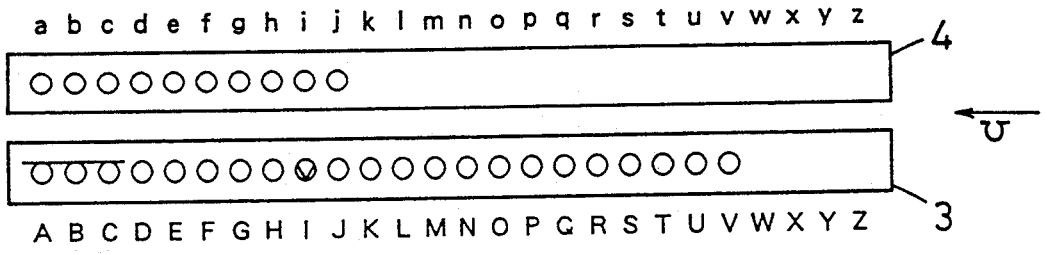
Figures 5, 6, 7:
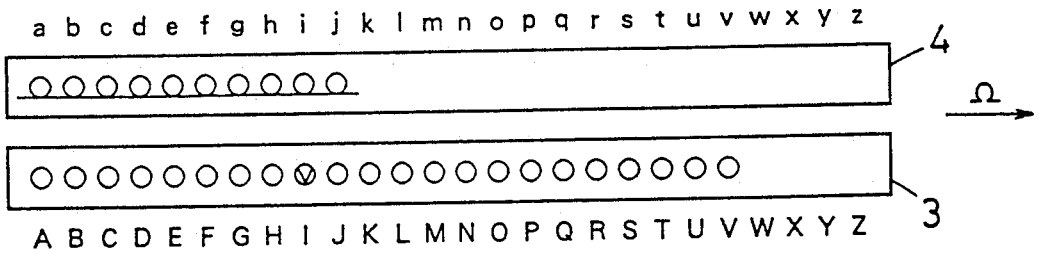
Figures 5, 6, 7, 8:
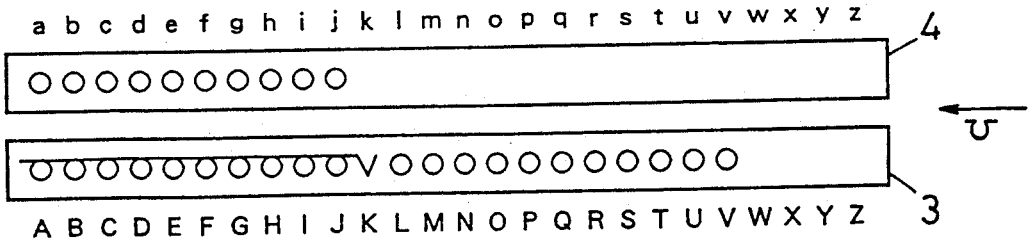
Figures 5, 6, 7, 8, 9:
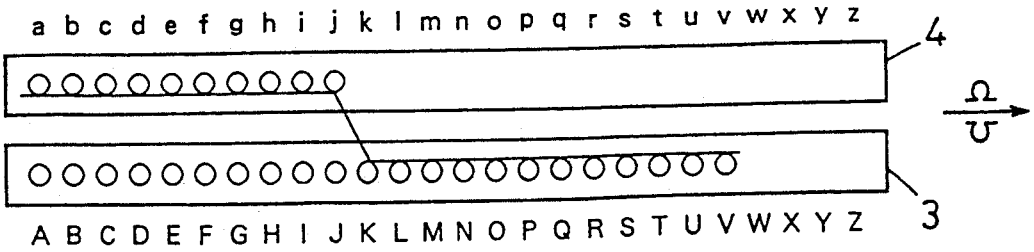
Figures 5, 6, 7, 8, 9, 10:
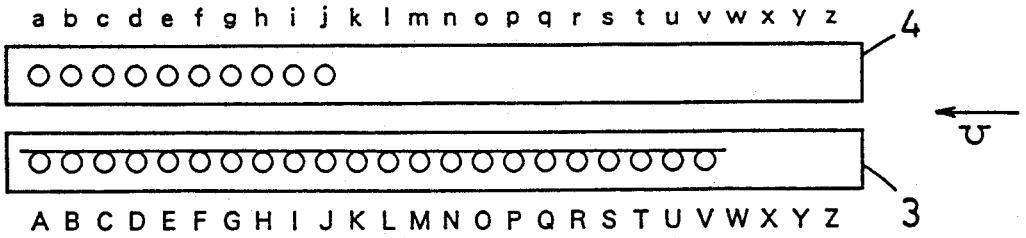
Figures 1, 6:
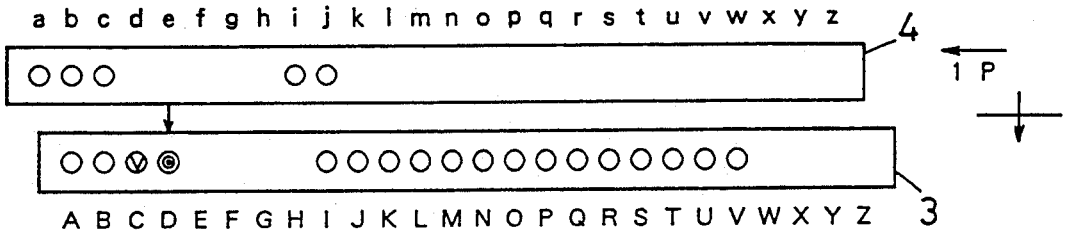
Figures 2, 6:
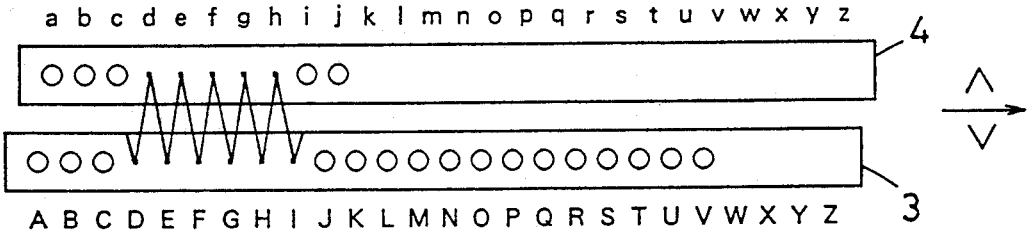
Figures 3, 6:
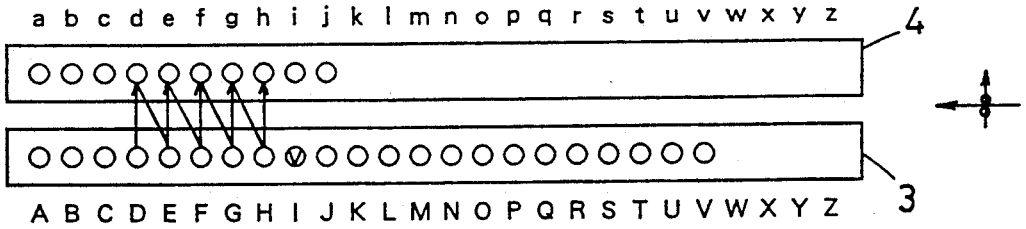
Figures 4, 6:
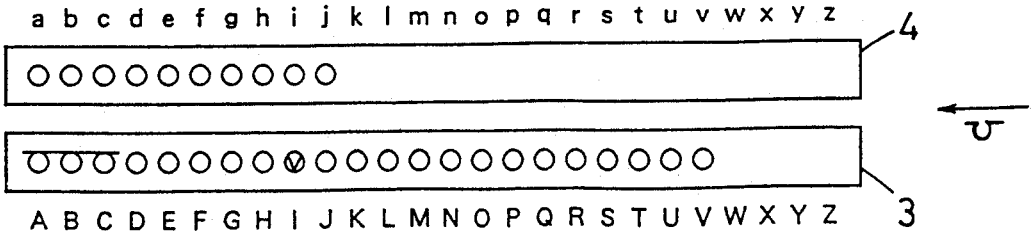
Figures 5, 6:
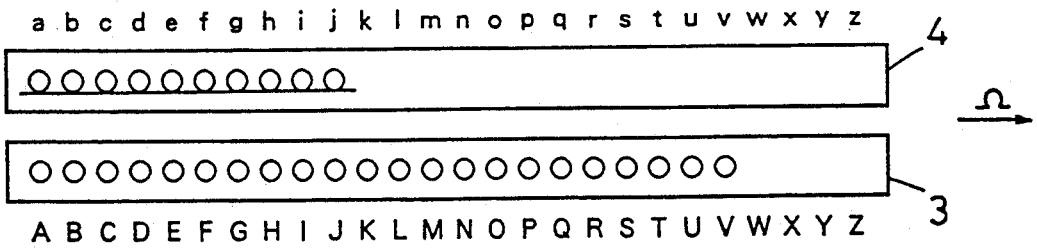
Figure 6:
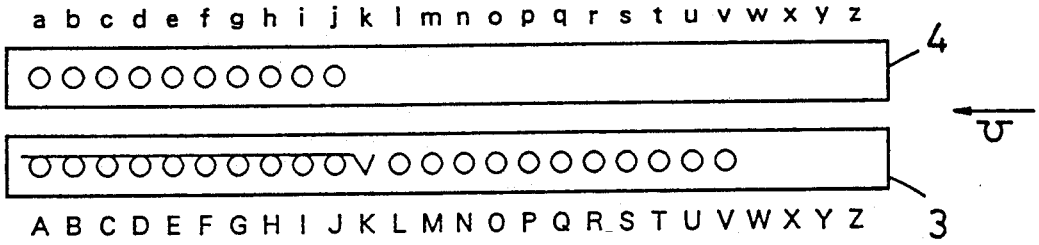
Figures 6, 7:
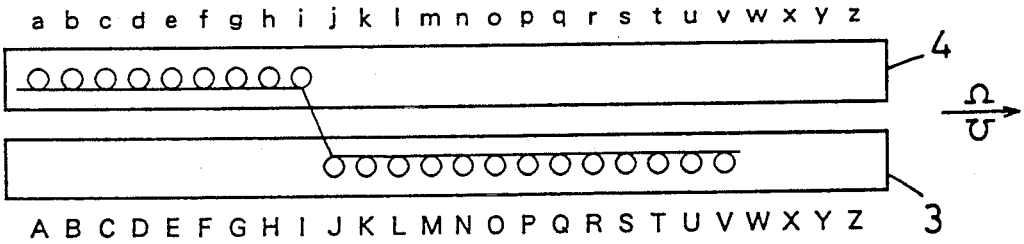
Figures 6, 7, 8:
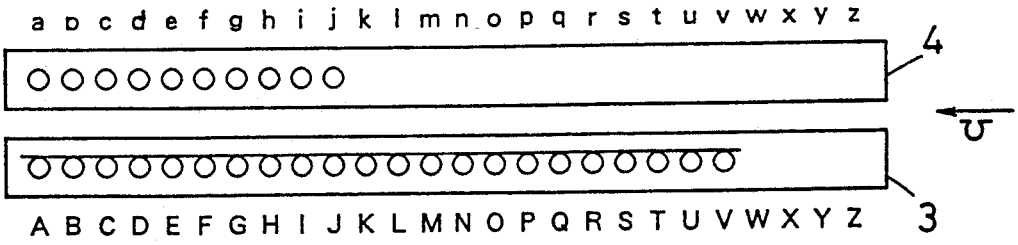
Figures 1, 7:
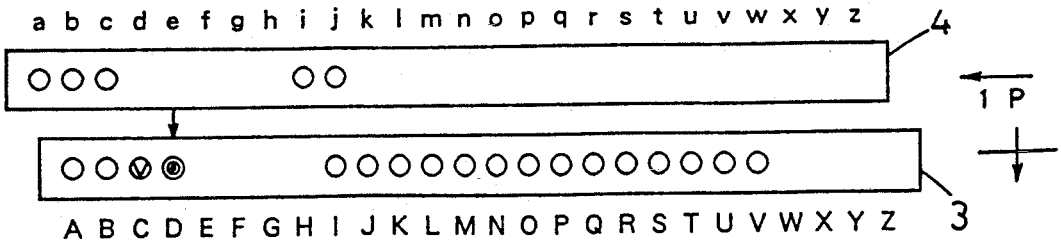
Figures 2, 7:
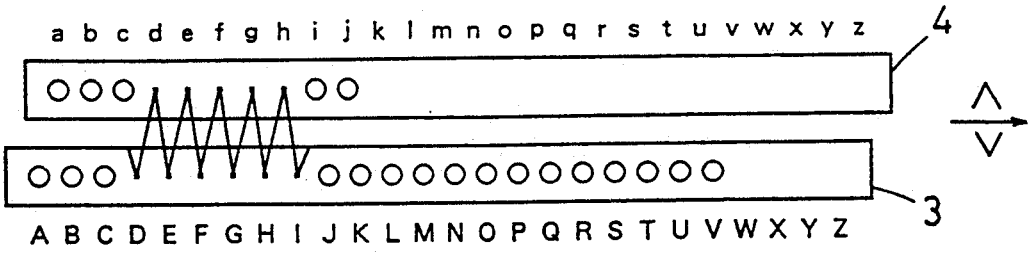
Figures 3, 7:
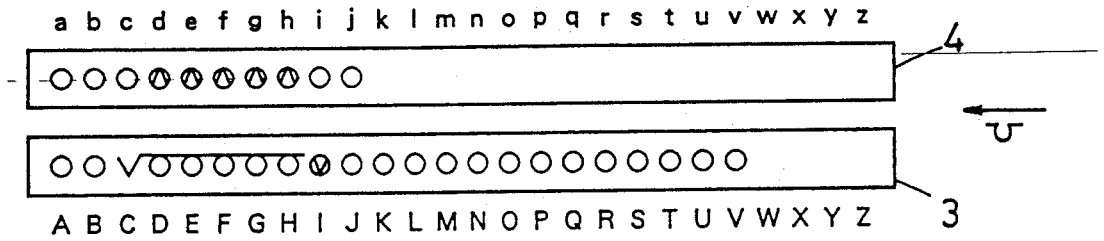
Figures 4, 7:
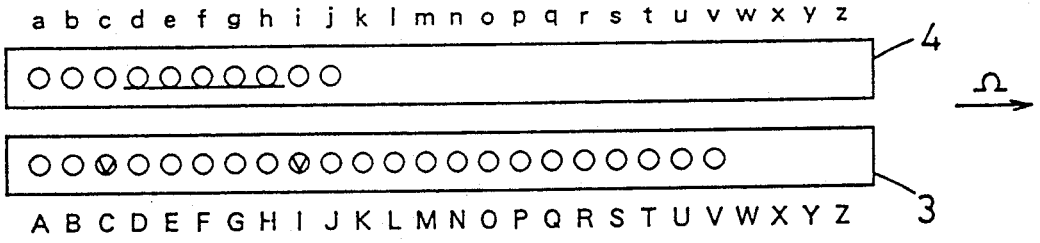
Figures 5, 7:
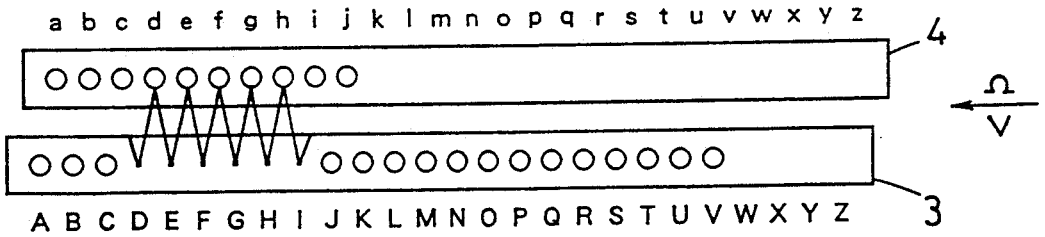
Figures 6, 7:
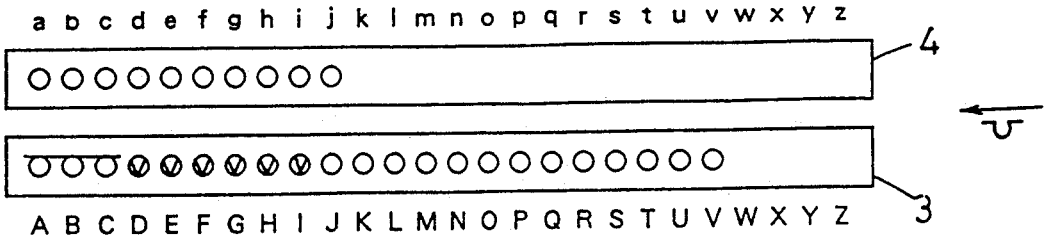
Figure 7:
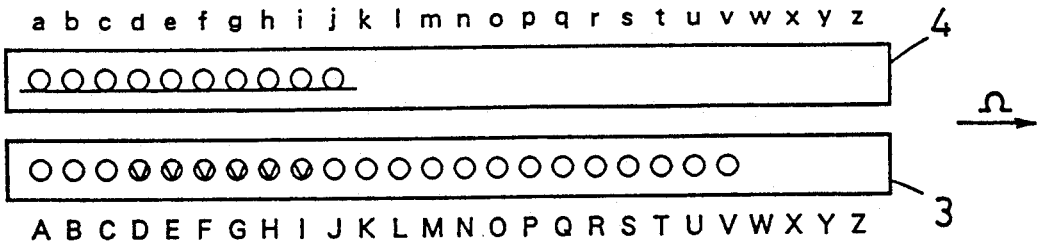
Figures 7, 8:
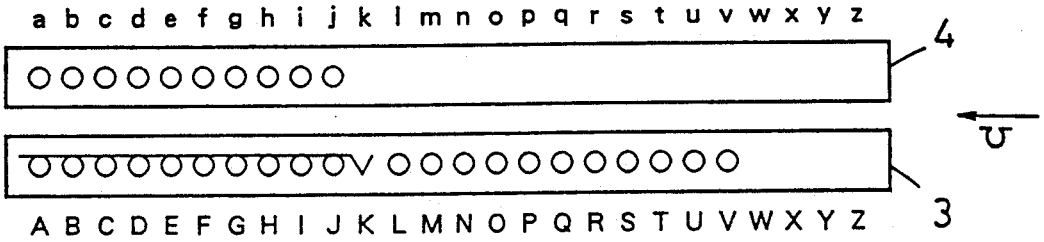
Figures 7, 8, 9:
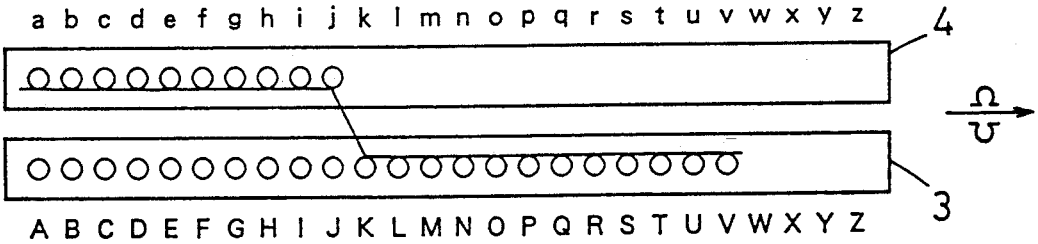
Figures 7, 8, 9, 10:
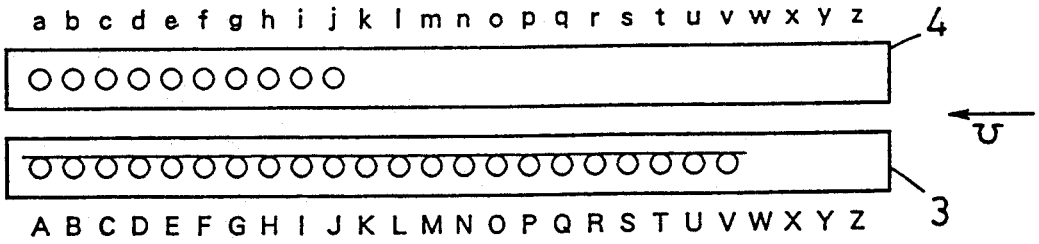
Figures 7, 8, 9, 10, 11:
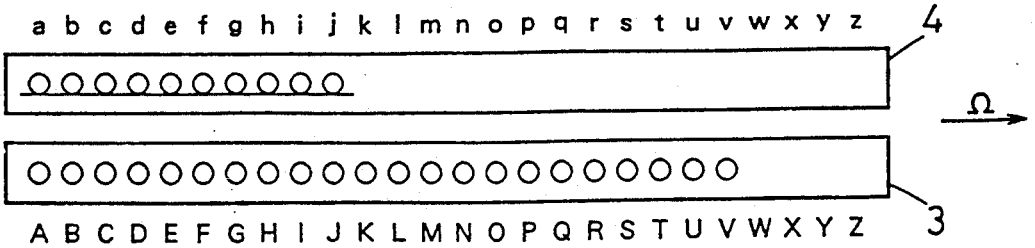

Further, marks used in the drawings are explained in FIG. 2, alphabetical capital letters A, B, C, D, E, . . . represent knitting needles of the front needle bed 3, alphabetical small case letters a, b, c, d, e, . . . represent knitting needles of the rear needle bed 4, and rightward numeral and letter P denote the distance of movement of the rear needle bed 4.

Figures 3, 4:
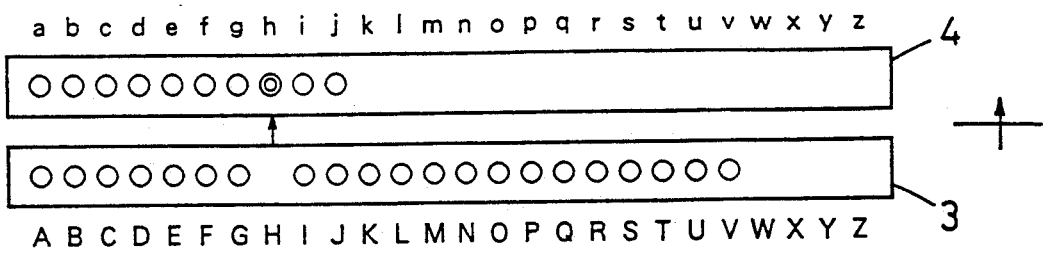

First, knitting starts from a bottom end 1*a* of the cardigan 1, and tubular knit fabric on which the buttonhole 2 is to be formed is knitted by the front and rear knitting needles as shown in knitting courses of FIGS. 3-1 to 3-2.

At the beginning of knitting the buttonhole 2, a loop is formed on the front knitting needle H which places at the right-end of the buttonhole 2 as shown in FIG. 3-3 and then the loop held on the knitting needle H is transferred to the rear knitting needle h which holds a loop in FIG. 3-4.

Next, the two loops held on the rear knitting needle h are transferred to the front knitting needle G after the rear needle bed 4 is moved 1 pitch leftward. Then, the front knitting needle G now holds three loops and the front knitting needle H and the rear knitting needle h become empty.

Figures 3, 4, 5:
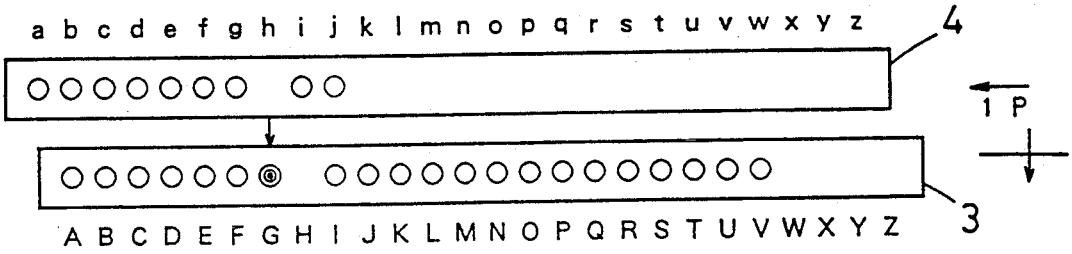

The knitting courses in FIGS. 3-3 to 3-5 are repeated in FIGS. 3-6 to 3-8 and in FIGS. 3-9 to 3-11 for predetermined times, and when knitting comes to the left-end of the buttonhole 2, at the front knitting needle E, for example, a supplied yarn is tucked on the front knitting needle C and forms a loop on each of the front knitting needles E, D as shown in FIG. 3-12.

After the loop held on the front knitting needle E is transferred to the rear knitting needle e in FIG. 3-13, the rear needle bed 4 is moved 1 pitch leftward and then the loop held on the rear knitting needle e is transferred to the front knitting needle D in FIG. 3-14. As a result, a bottom peripheral portion 2*a* of the buttonhole 2 is formed on the front knitting needles H to E.

After the bottom peripheral portion 2*a* of the buttonhole 2 is formed, a top peripheral portion 2*b* of the buttonhole 2 is formed as described below.

In FIG. 3-15, a loop held on the front knitting needle D is made to be held also on the rear knitting needle d. In FIG. 3-16, a new loop is formed on the rear knitting needle d, and the new loop is transferred to the front knitting needle E after the rear needle bed 4 is moved 1 pitch rightward in FIG. 3-17. Thus the front knitting needle E which was empty in FIG. 3-14 holds a loop now, that is, a number of stitches has increased.

The procedure to increase stitches as in FIGS. 3-15 to 3-17 is repeated in FIGS. 3-18 to 3-20, FIGS. 3-21 to 3-23 and FIGS. 3-24 to 3-26 for predetermined times and then the front knitting needles E to H which were empty in FIG. 3-14 come to hold a loop respectively.

In FIG. 3-27, the loop held on the front knitting needle H is made to be held also on the rear knitting needle h. In FIG. 3-28, a new loop is formed on the rear knitting needle h, and the new loop is transferred to the front knitting needle I after the rear needle bed 4 is moved 1 pitch rightward in FIG. 3-29. Then the front knitting needle I holds two loops which reinforce the right-end portion of the buttonhole 2.

On the other hand, the rear knitting needles d to h which have been knitting the back knitting part of the tubular knit fabric consisting of front and back knitting parts are empty at the buttonhole 2. In this place, after the rear needle bed 4 is moved 1 pitch leftward in FIG. 3-30, the loops held on the front knitting needles D to H are made to be held also on the rear knitting needles d to h respectively.

Accordingly, new loops are formed on the front knitting needles A to C by supplying a yarn in FIG. 3-31, and in FIG. 3-32, new loops are formed on the rear knitting needles a to j by supplying a yarn, thus the back knitting part at the top peripheral portion 2*b* of the buttonhole 2 is knitted.

In FIG. 3-33, a yarn tucked on the front knitting needle K is supplied to the front knitting needle J to A and loops are formed on them. In FIG. 3-34, a yarn is supplied to the rear knitting needles a to j and the front knitting needles K to V and a loop is formed on each of them. Further, in FIG. 3-35, a yarn is supplied to the front knitting needles A to V to form loops on them, and in FIG. 3-36, a yarn is supplied to the rear knitting needles a to j and loops are formed on them. Furthermore, in FIG. 3-37, a yarn tucked on the front knitting needle K is supplied to the front knitting needle J to A and loops are formed on them.

By repeating the knitting courses in FIGS. 3-34 to 3-37 for predetermined times, the body part of the cardigan 1 is formed.

In this way, the lowest buttonhole 2 and the knitting fabric around the buttonhole 2 is knitted.

The above knitting courses for the buttonhole 2 and the knitting fabric around the buttonhole 2 are repeated for expected times.

In the above embodiment, the back knitting part at the top peripheral portion 2*b* of the buttonhole 2 in the tubular knit fabric is knitted by using a method of making one loop be held on two confronting knitting needles. However, it is needless to say that loops may be formed on the rear knitting needles by supplying a yarn in a zigzag pattern between the front knitting needles and the empty rear knitting needles.

Embodiment 2

In a knitting method for a buttonhole in a knit product in the embodiment 2, the bottom peripheral portion 2*a* of the buttonhole 2 is formed in the same way as the embodiment 1, but on and after FIG. 3-14, the embodiment 2 employs a knitting procedure that is different from that in the embodiment 1 for knitting the top peripheral portion 2*b* of the buttonhole 2 as described below.

After the bottom peripheral portion 2*a* of the buttonhole 2 is formed on the front knitting needles H to E, that is, after a knitting course in FIG. 4-1, a yarn is supplied in a zigzag pattern between the front knitting needles D to I and the rear knitting needles d to h as shown in FIG. 4-2. In FIG. 4-3, a yarn is supplied to the loops which have been formed on the front knitting needles D to H to form new loops and at the same time the old loops are transferred to the rear knitting needles d to h.

Figures 3, 4, 5, 6:
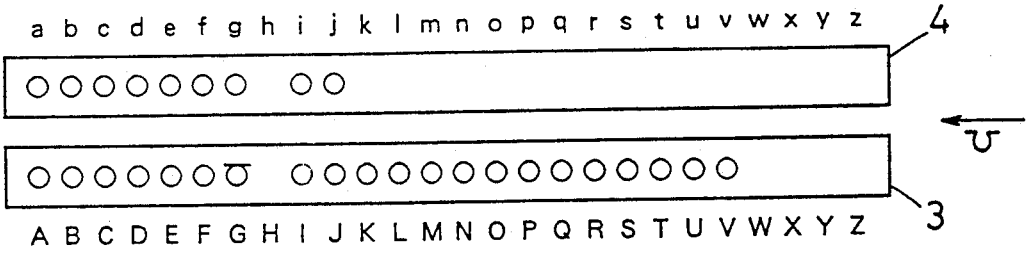

Further, in FIG. 4-4, a yarn tucked on the front knitting needles C and I forms loops on the front knitting needles D to H and the loops are transferred to the rear knitting needles d to h in FIG. 4-5 in the same way as shown in FIG. 4-3. In FIG. 4-6, a yarn is supplied to the front knitting needles A to C to form loops on them and in FIG. 4-7, a yarn is supplied to the rear knitting needles a to j to form loops on them.

Furthermore, a yarn tucked on the front knitting needle K is supplied to the front knitting needles A to J to form loops on them in FIG. 4-8, and in FIG. 4-9, a yarn is supplied to the rear knitting needles a to j and the front knitting needles K to V and a loop is formed on each of the knitting needles.

By repeating the knitting courses in FIGS. 4-7 to 4-10 for predetermined times, the body part of the cardigan 1 is knitted.

In this way, the lowest buttonhole 2 and the knitting fabric around the buttonhole 2 in the cardigan 1 are knitted.

The above knitting courses for the buttonhole 2 and the knitting fabric around the buttonhole 2 are repeated for a necessary number of courses.

The procedure to form the buttonhole 2 in the embodiment 2 has an advantage that it needs a less number of knitting courses than that in the embodiment 1.

Embodiment 3

In a knitting method for a buttonhole in a knit product in the embodiment 3, the bottom peripheral portion 2*a* of the buttonhole 2 is formed in the same way as the embodiment 1, but on and after FIG. 3-14, the embodiment 2 employs a knitting procedure that is different from that in the embodiment 1 for knitting the top peripheral portion 2*b* of the buttonhole 2 as described below.

After the bottom peripheral portion 2*a* of the buttonhole 2 is formed on the front knitting needles H to E, that is, after a knitting course in FIG. 5-1, a yarn is supplied in a zigzag pattern between the front knitting needles D to I and the rear knitting needles d to h as shown in FIG. 5-2. In FIG. 5-3, a yarn tucked on the front knitting needle C is supplied to the front knitting needles D to H to form loops on them.

Further, in FIG. 5-4, a yarn is supplied to the rear knitting needles d to h to form loops and the yarn is also tucked on the front knitting needle I. In FIG. 5-5, the loops held on the front knitting needles D to H are made to be held also on the rear knitting needles d to h.

Figures 3, 4, 5, 6, 7:
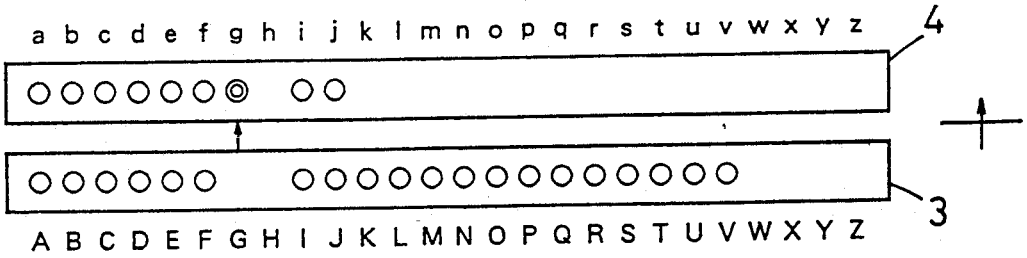

Furthermore, a yarn is supplied to the front knitting needles A to C to form loops on them in FIG. 5-6 and a yarn is supplied to the rear knitting needles a to j to form loops on them in FIG. 5-7.

Subsequently, a yarn tucked on the front knitting needle K is supplied to the front knitting needles A to J to form loops on them in FIG. 5-8. Further, in FIG. 5-9, a yarn is supplied to the rear knitting needles to j and then front knitting needles K to form loops on them.

By repeating the knitting courses in FIGS. 5-7 to 5-10 for predetermined times, the body part of the cardigan 1 is knitted.

In this way, the lowest buttonhole 2 and the knitting fabric around the buttonhole 2 in the cardigan 1 are knitted.

The above knitting courses for the buttonhole 2 and the knitting fabric around the buttonhole 2 are repeated for a necessary number of courses.

Embodiment 4

In a knitting method for a buttonhole of a knit product in the embodiment 4, the bottom peripheral portion 2*a* of the buttonhole 2 is formed in the same way as the embodiment 1, but on and after FIG. 3-14, the embodiment 2 employs a knitting procedure that is different from that in the embodiment 1 for knitting the top peripheral portion 2*b* of the buttonhole 2 as described below.

After the bottom peripheral portion 2*a* of the buttonhole 2 is formed on the front knitting needles H to E, that is, after a knitting course in FIG. 6-1, a yarn is supplied in a zigzag pattern between the front knitting needles D to I and the rear knitting needles d to h as shown in FIG. 6-2. In FIG. 6-3, a yarn is supplied to the loops which have been formed on the front knitting needles D to H to form new loops and at the same time the old loops are transferred to the rear knitting needles d to h.

In FIG. 6-4, a yarn is supplied to the front knitting needles A to C to form loops on them, and after that, a yarn is supplied to the rear knitting needles a to j to form loops on them as shown in FIG. 6-5.

Further, a yarn tucked on the front knitting needle K is supplied to the front knitting needles A to J to form loops on them in FIG. 6-6. In FIG. 6-7, a yarn is supplied to the rear knitting needles a to i and the front knitting needles J to V to form loops on them.

By repeating the knitting courses in FIGS. 6-5 to 6-8 for predetermined times, the body part of the cardigan 1 is knitted.

In this way, the lowest buttonhole 2 and the knitting fabric around the buttonhole 2 in the cardigan 1 are knitted.

The above knitting courses for the buttonhole 2 and the knitting fabric around the buttonhole 2 are repeated for necessary times.

Embodiment 5

In a knitting method for a buttonhole in a knit product in the embodiment 5, the bottom peripheral portion 2*a* of the buttonhole 2 is formed in the same way as the embodiment 1, but on and after FIG. 3-14, the embodiment 2 employs a knitting procedure that is different from that in the embodiment 1 for knitting the top peripheral portion 2*b* of the buttonhole 2 as described below.

After the bottom peripheral portion 2*a* of the buttonhole 2 is formed on the front knitting needles E to H, that is, after a knitting course in FIG. 7-1, a yarn is supplied in a zigzag pattern between the front knitting needles D to I and the rear knitting needles d to h as shown in FIG. 7-2. In FIG. 7-3, a yarn tucked on the front knitting needle C is supplied to the front knitting needles D to H to form loops on them.

In FIG. 7-4, a yarn is supplied to the rear knitting needles d to h to form loops on them. In FIG. 7-5, a yarn is supplied in a zigzag pattern between the front knitting needles D to I and the rear knitting needles d to h. In FIG. 7-6, a yarn is supplied to the front knitting needles A to C to form loops on them.

Figures 3, 4, 5, 6, 7, 8:
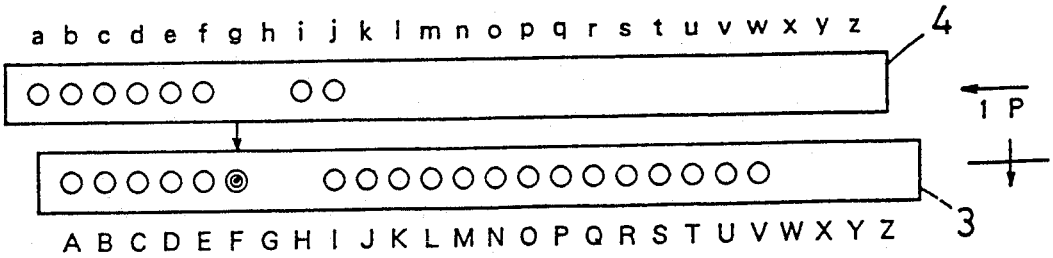
Figures 3, 4, 5, 6, 7, 8, 9:
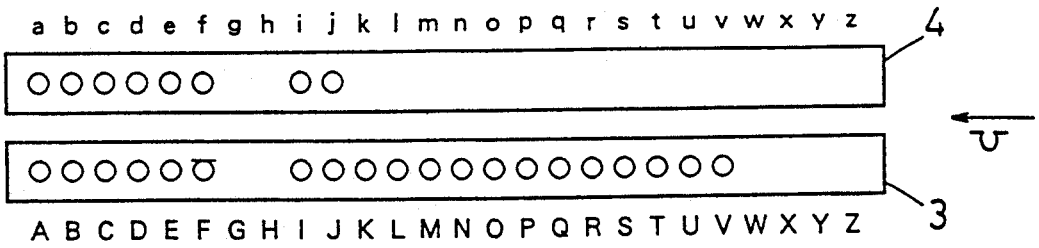
Figures 3, 4, 5, 6, 7, 8, 9, 10:
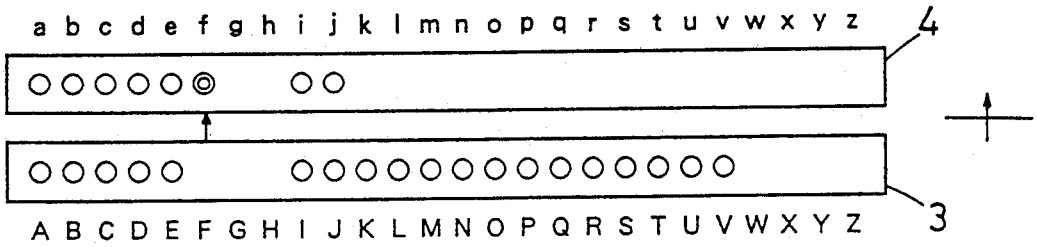
Figures 3, 4, 5, 6, 7, 8, 9, 10, 11:
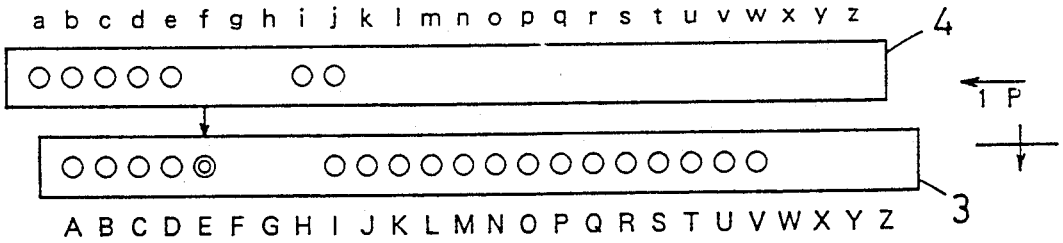
Figures 3, 4, 5, 6, 7, 8, 9, 10, 11, 12:
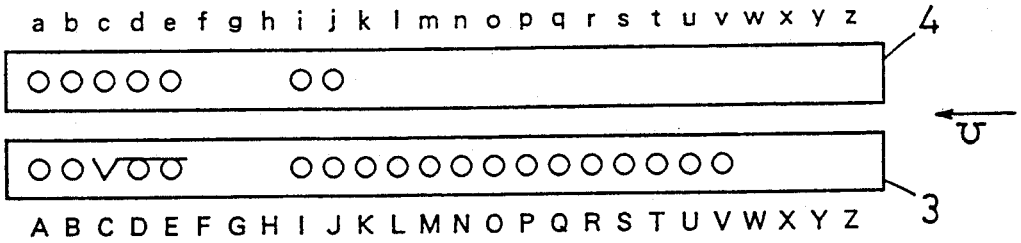
Figures 3, 4, 5, 6, 7, 8, 9, 10, 11, 12, 13:
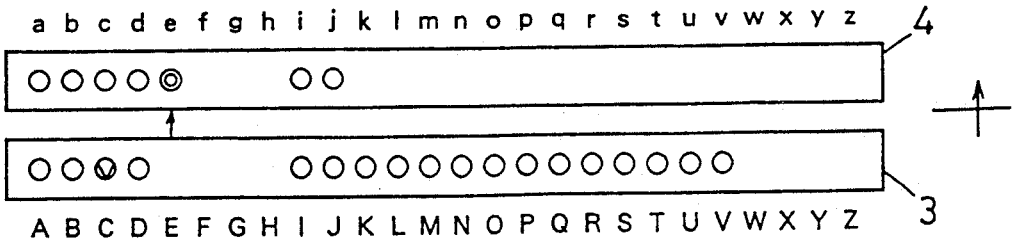
Figures 3, 4, 5, 6, 7, 8, 9, 10, 11, 12, 13, 14:
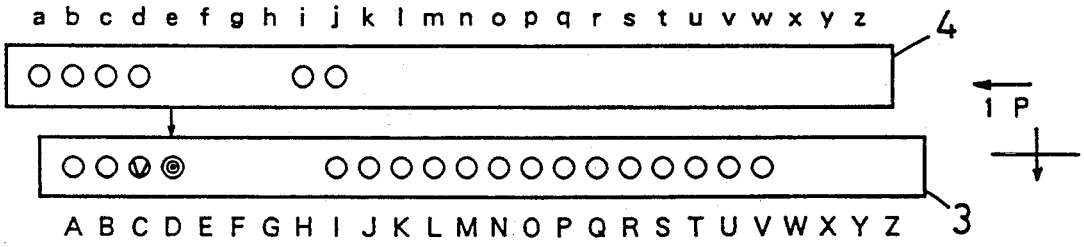
Figures 3, 4, 5, 6, 7, 8, 9, 10, 11, 12, 13, 14, 15:
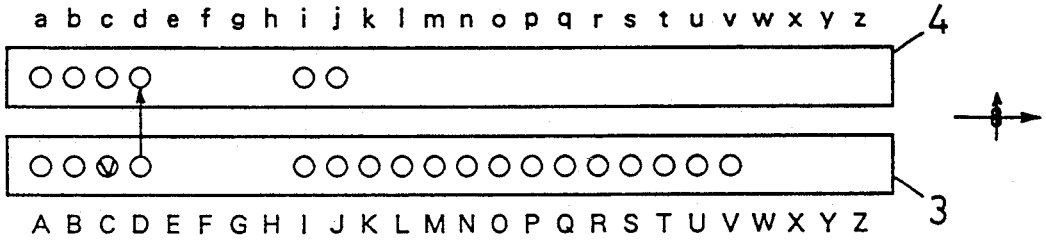
Figures 3, 4, 5, 6, 7, 8, 9, 10, 11, 12, 13, 14, 15, 16:
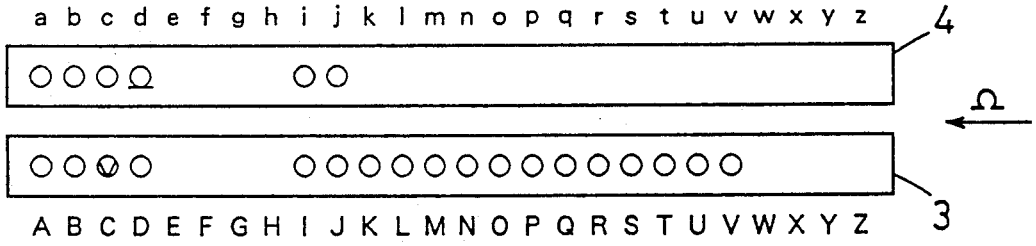
Figures 3, 4, 5, 6, 7, 8, 9, 10, 11, 12, 13, 14, 15, 16, 17:
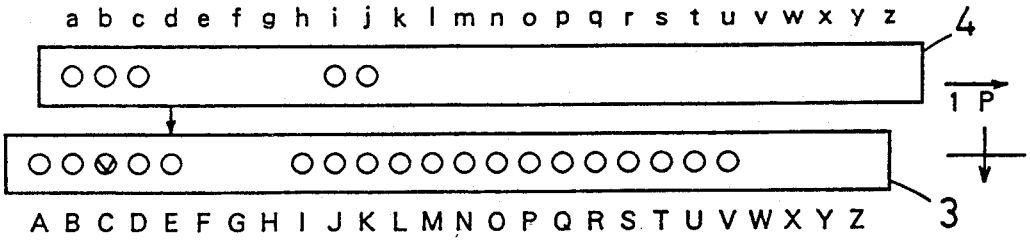
Figures 3, 4, 5, 6, 7, 8, 9, 10, 11, 12, 13, 14, 15, 16, 17, 18:
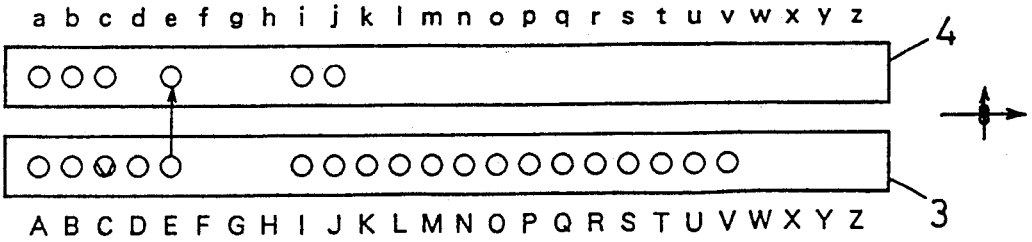
Figures 3, 4, 5, 6, 7, 8, 9, 10, 11, 12, 13, 14, 15, 16, 17, 18, 19:
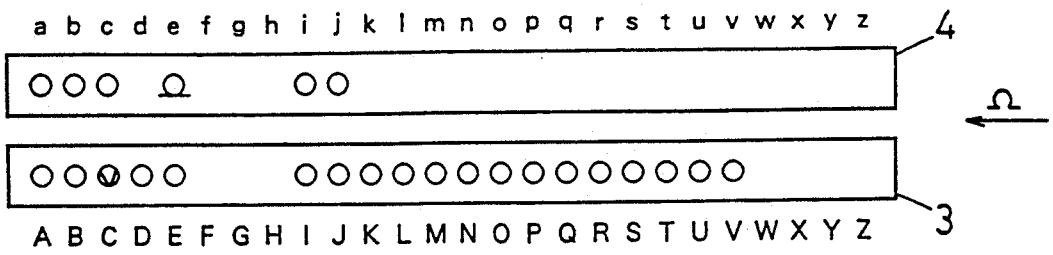
Figures 3, 4, 5, 6, 7, 8, 9, 10, 11, 12, 13, 14, 15, 16, 17, 18, 19, 20:
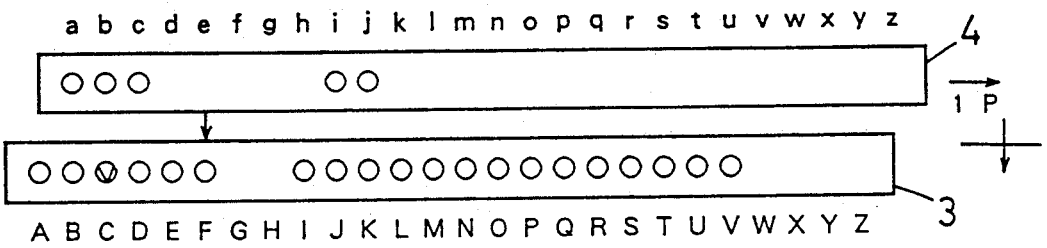
Figures 3, 4, 5, 6, 7, 8, 9, 10, 11, 12, 13, 14, 15, 16, 17, 18, 19, 20, 21:
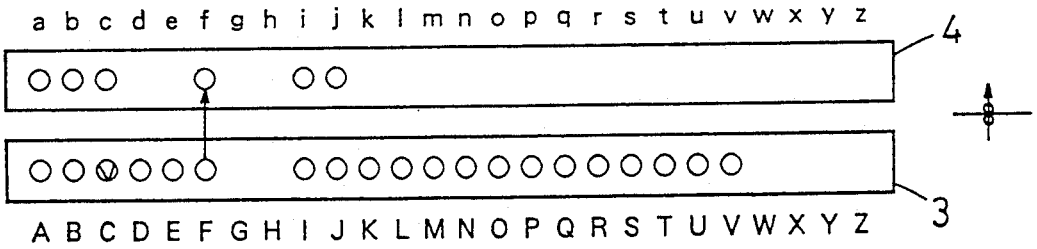
Figures 3, 4, 5, 6, 7, 8, 9, 10, 11, 12, 13, 14, 15, 16, 17, 18, 19, 20, 21, 22:
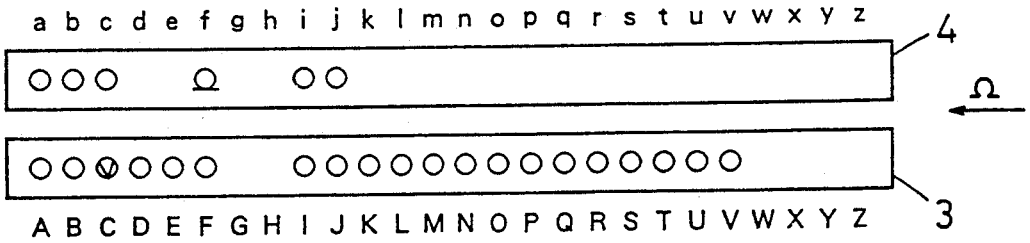
Figures 3, 4, 5, 6, 7, 8, 9, 10, 11, 12, 13, 14, 15, 16, 17, 18, 19, 20, 21, 22, 23:
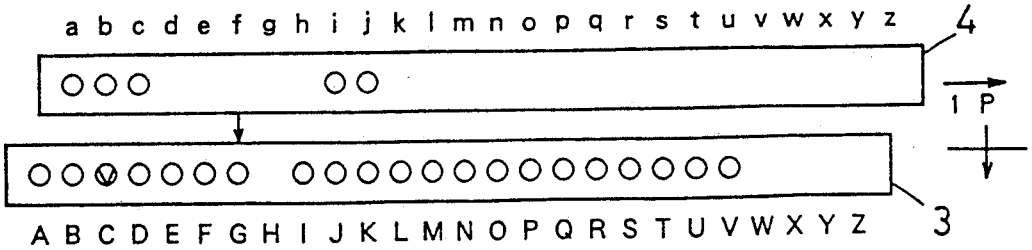
Figures 3, 4, 5, 6, 7, 8, 9, 10, 11, 12, 13, 14, 15, 16, 17, 18, 19, 20, 21, 22, 23, 24:
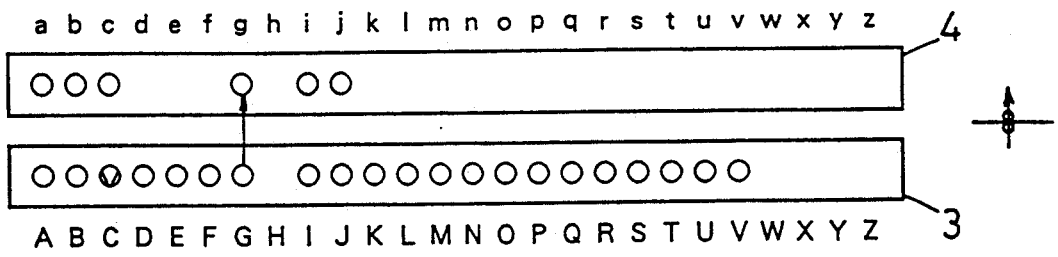
Figures 3, 4, 5, 6, 7, 8, 9, 10, 11, 12, 13, 14, 15, 16, 17, 18, 19, 20, 21, 22, 23, 24, 25:
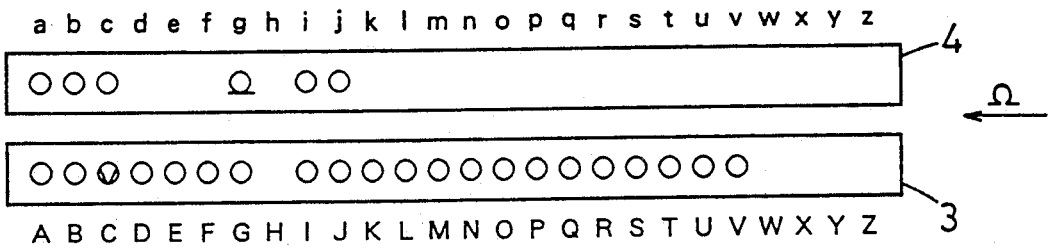
Figures 3, 4, 5, 6, 7, 8, 9, 10, 11, 12, 13, 14, 15, 16, 17, 18, 19, 20, 21, 22, 23, 24, 25, 26:
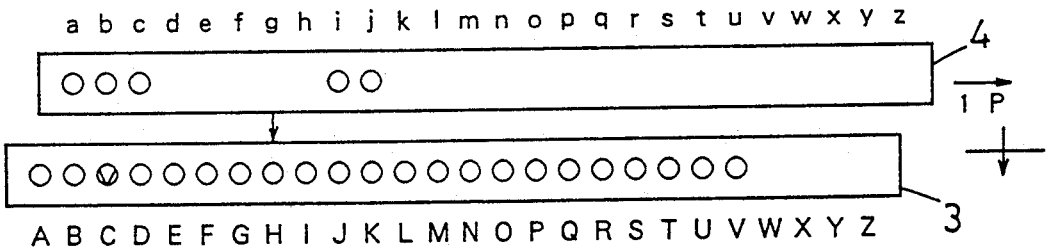
Figures 3, 4, 5, 6, 7, 8, 9, 10, 11, 12, 13, 14, 15, 16, 17, 18, 19, 20, 21, 22, 23, 24, 25, 26, 27:
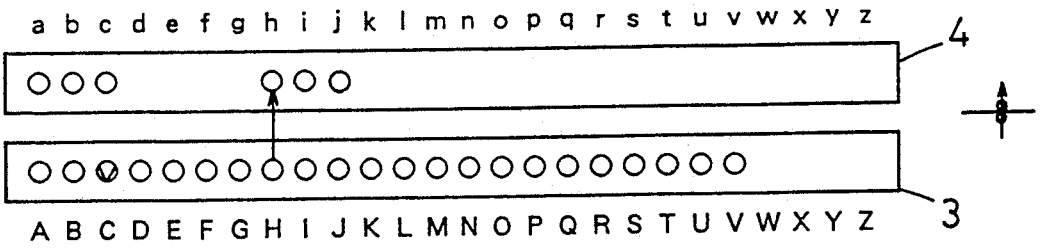
Figures 3, 4, 5, 6, 7, 8, 9, 10, 11, 12, 13, 14, 15, 16, 17, 18, 19, 20, 21, 22, 23, 24, 25, 26, 27, 28:
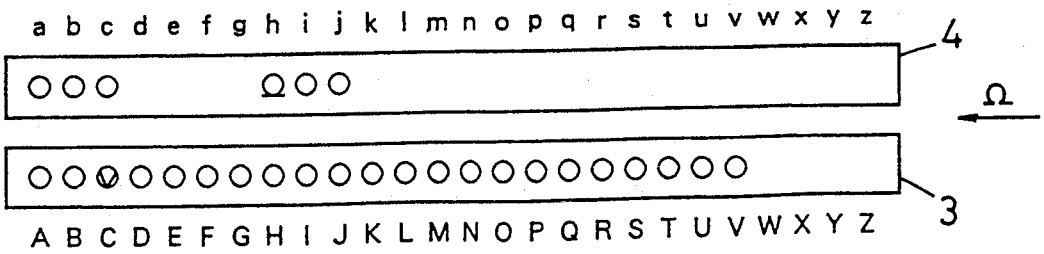
Figures 3, 4, 5, 6, 7, 8, 9, 10, 11, 12, 13, 14, 15, 16, 17, 18, 19, 20, 21, 22, 23, 24, 25, 26, 27, 28, 29:
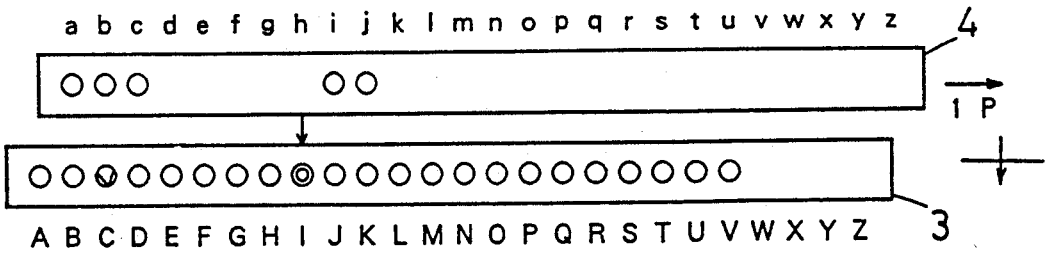
Figures 3, 4, 5, 6, 7, 8, 9, 10, 11, 12, 13, 14, 15, 16, 17, 18, 19, 20, 21, 22, 23, 24, 25, 26, 27, 28, 29, 30:
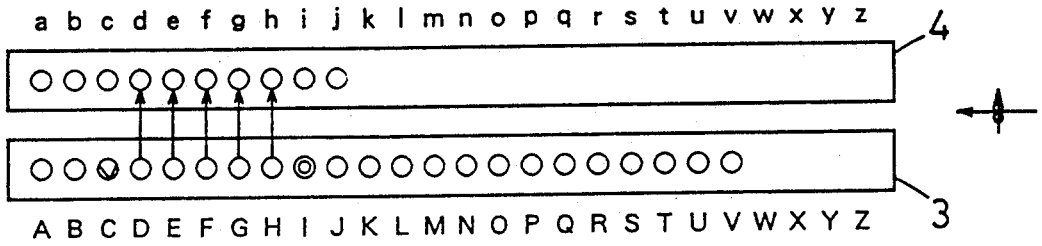
Figures 3, 4, 5, 6, 7, 8, 9, 10, 11, 12, 13, 14, 15, 16, 17, 18, 19, 20, 21, 22, 23, 24, 25, 26, 27, 28, 29, 30, 31:
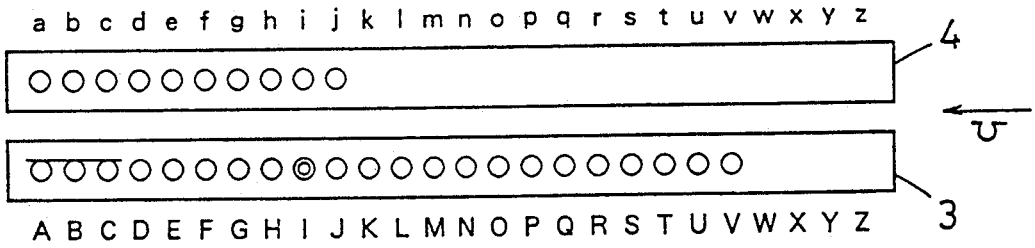
Figures 3, 4, 5, 6, 7, 8, 9, 10, 11, 12, 13, 14, 15, 16, 17, 18, 19, 20, 21, 22, 23, 24, 25, 26, 27, 28, 29, 30, 31, 32:
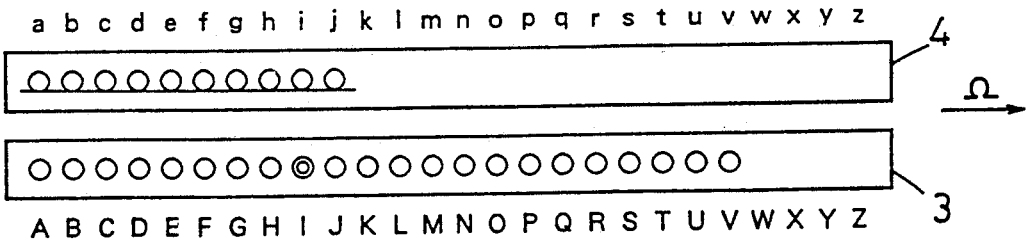
Figures 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33:
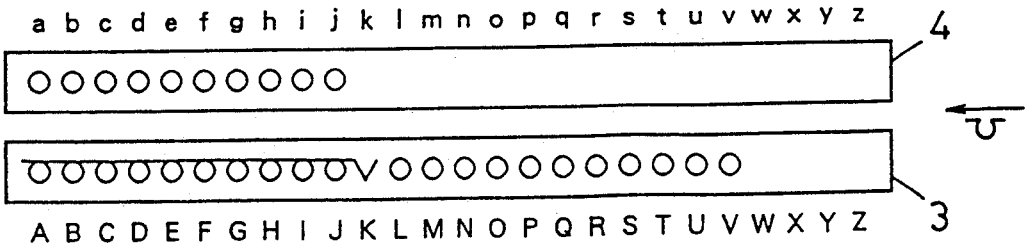
Figures 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34:
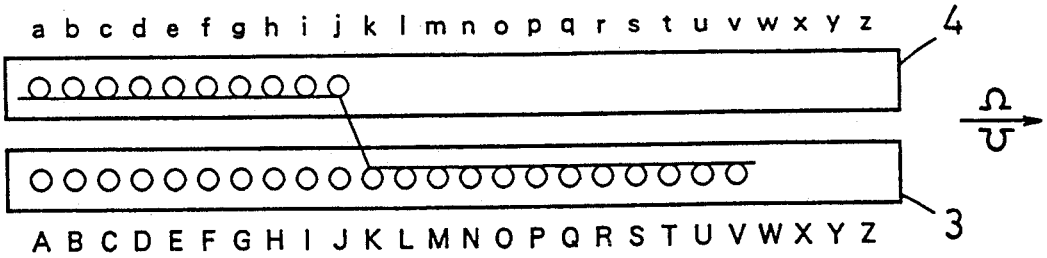
Figures 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35:
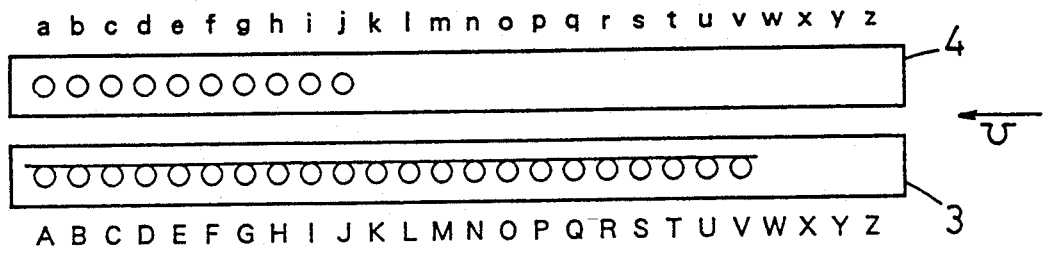
Figures 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36:
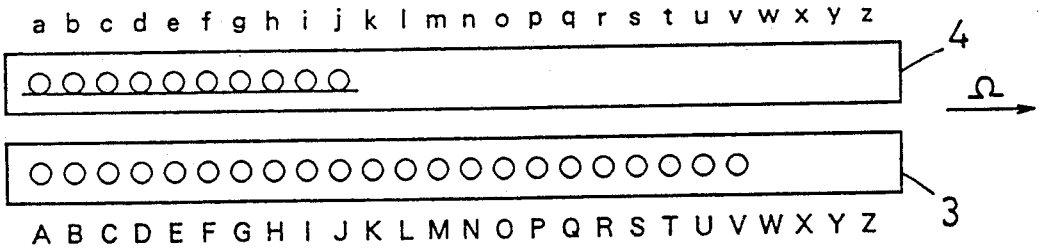
Figures 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37:
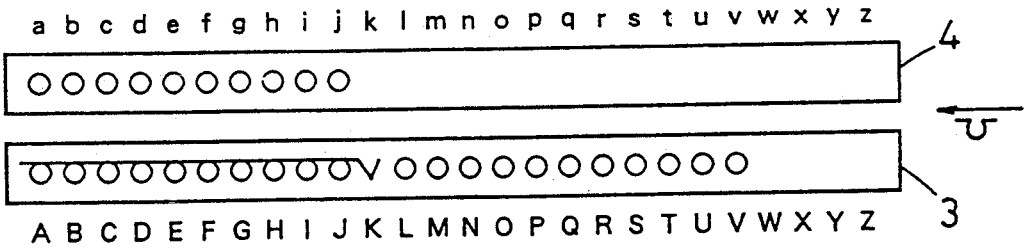
Figures 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38:
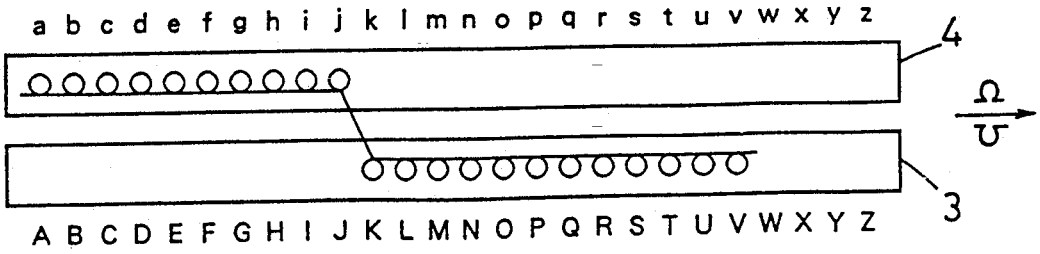

Further, a loop is supplied to the rear knitting needles a to j to form loops on them in FIG. 7-7, and subsequently in FIG. 7-8, a yarn tucked on the front knitting needle K is supplied to the front knitting needles A to J to form loops on them. In FIG. 7-9, a yarn is supplied to the rear knitting needles a to j and the front knitting needles K to V to form loops on them.

By repeating the knitting courses in FIGS. 7-8 to 7-11 for predetermined times, the body part of the cardigan 1 is knitted.

In this way, the lowest buttonhole 2 and the knitting fabric around the buttonhole 2 in the cardigan 1 are knitted.

The above knitting courses for the buttonhole 2 and the knitting fabric around the buttonhole 2 are repeated for a necessary number of courses.

In the above embodiments, a flat knitting machine having a pair of front and rear needle beds is used. However, it is needless to say that a flat knitting machine used in the invention is not limited to the one having such a construction but two pair of confronting needle beds might be provided on the flat knitting machine.

The foregoing relates to a preferred exemplary embodiment of the invention, it being understood that other variants and embodiments thereof are possible within the spirit and scope of the invention, the latter being defined by the appended.

We claim:

1. A method for knitting a buttonhole lateral to a wale direction with a flat knitting machine having empty front and rear knitting needles for a knit product comprising the steps for forming a bottom peripheral portion of the buttonhole and the steps for forming an upper peripheral portion of the buttonhole, the steps for forming a bottom peripheral portion of the buttonhole beginning at a right end of the buttonhole comprising:

feeding a thread to a first front knitting needle to form a loop, transferring the loop held on the first front knitting needle to a corresponding rear knitting needle which holds a second loop, thus emptying the front knitting needle, racking the needles and transferring the two loops held on the rear knitting needle to a second front knitting needle, said second front knitting needle being leftward and adjacent to the first front knitting needle, thus emptying the rear knitting needle, and repeated the above steps leftward to form a bottom peripheral portion of the buttonhole, the steps for forming an upper peripheral portion of the buttonhole beginning at a left end of the buttonhole comprising:

hooking a loop held on a originating front knitting needle by a corresponding rear knitting needle, feeding a thread to the rear knitting needle to form a loop, racking the needle bed rightward and transferring the loop to an empty front knitting needle, said empty front knitting needle being rightward and adjacent to the original front knitting needle, and repeating the above steps for forming an upper peripheral portion, rightward to increase the number of loops on the front knitting needles.

* * * * *